US010722007B2

(12) United States Patent
Upson-Tyler

(10) Patent No.: US 10,722,007 B2
(45) Date of Patent: Jul. 28, 2020

(54) SCAR COVERING JEWELRY DEVICE

(71) Applicant: Donnese Upson-Tyler, Springdale, MD (US)

(72) Inventor: Donnese Upson-Tyler, Springdale, MD (US)

( * ) Notice: Subject to any disclaimer, the term of this patent is extended or adjusted under 35 U.S.C. 154(b) by 0 days.

(21) Appl. No.: 16/037,244

(22) Filed: Jul. 17, 2018

(65) Prior Publication Data

US 2019/0059529 A1 Feb. 28, 2019

Related U.S. Application Data

(60) Provisional application No. 62/548,599, filed on Aug. 22, 2017.

(51) Int. Cl.
*A44C 15/00* (2006.01)

(52) U.S. Cl.
CPC ..... *A44C 15/005* (2013.01); *A44C 15/0005* (2013.01)

(58) Field of Classification Search
CPC . A44C 15/0005; A44C 25/001; A44C 15/005; A44C 5/0007; A44C 25/00; A41D 23/00; A41D 1/002; B44C 1/105; A45D 44/22; A41B 15/00; Y10T 428/23943; Y10S 63/01; Y10S 428/905
USPC ..... 63/14.9, 3.1
See application file for complete search history.

(56) References Cited

U.S. PATENT DOCUMENTS

| | | | | |
|---|---|---|---|---|
| 1,140,975 | A * | 5/1915 | Frankel | A41B 15/00 2/1 |
| 1,300,592 | A * | 4/1919 | Essig | A41B 15/00 2/1 |
| 3,119,389 | A * | 1/1964 | Ritzcovan | A45D 44/22 606/204.35 |
| 3,727,609 | A * | 4/1973 | Hale | A45D 44/22 606/204.35 |
| 5,279,132 | A * | 1/1994 | Swaim | A44C 15/00 63/1.18 |
| 6,255,553 | B1 | 7/2001 | Sullivan | |
| 6,293,913 | B1 * | 9/2001 | Tsujino | A61B 8/06 600/450 |
| 6,455,752 | B1 | 9/2002 | Vesey | |
| 6,789,542 | B1 | 9/2004 | Bischoff | |
| 6,935,135 | B1 * | 8/2005 | Brady | A44C 11/002 63/14.9 |
| 7,089,764 | B2 | 8/2006 | Brett | |

(Continued)

*Primary Examiner* — Jack W Lavinder
(74) *Attorney, Agent, or Firm* — Boudwin Intellectual Property; Daniel Boudwin

(57) ABSTRACT

A scar covering jewelry device. The scar covering jewelry device includes a pendant having a front side, a rear side, a first end, and a second end. An ornament is disposed on the front side of the pendant. A chain includes a second end and an opposing first end, wherein the first end of the chain is secured to the first end of the pendant and the second end of the chain secured to the second end of the pendant. A removable adhesive is disposed on the rear side of the pendant. The removable adhesive is configured to adhere to a bandage or directly to the wearer's skin, such that the pendant may be utilized to obscure a scar, injury, or other area of the skin the wearer wishes to cover. The removable adhesive allows the device to be removed without leaving a residue behind.

12 Claims, 3 Drawing Sheets

(56) References Cited

U.S. PATENT DOCUMENTS

| | | | | |
|---|---|---|---|---|
| 7,195,348 | B2 * | 3/2007 | Buchanan | B29C 66/53461 347/87 |
| 2002/0020190 | A1 * | 2/2002 | Clark | A44C 15/0005 63/14.9 |
| 2003/0106336 | A1 * | 6/2003 | Gaskill | A44C 5/0023 63/3 |
| 2010/0229356 | A1 | 9/2010 | LaRocque | |

* cited by examiner

SCAR COVERING JEWELRY DEVICE

CROSS REFERENCE TO RELATED APPLICATIONS

This application claims the benefit of U.S. Provisional Application No. 62/548,599 filed on Aug. 22, 2017. The above identified patent application is herein incorporated by reference in its entirety to provide continuity of disclosure.

BACKGROUND OF THE INVENTION

The present invention relates to jewelry devices. More specifically, the present invention provides a scar covering jewelry device including a removable adhesive backing adapted to adhere the device to a bandage or the wearer's skin, in an effort to prevent rubbing or knocking if the area is still sore or healing, which prevents further injury or harm and conceals a wound or scar while it heals.

When an individual undergoes surgery, a scar is often left behind on their skin. Other incidents such as injuries can leave scars, bruising, or other markings on the skin. The markings can be unsightly to some individuals, and the individual may wish to cover the marking to prevent others from seeing it. One option for covering a scar or other marking is to place a bandage over it. However, the bandage can be just as unsightly as the marking it is covering, and still alludes to the fact that there is an injury or other marking being covered. Some individuals may attempt to use jewelry to cover a skin marking, but jewelry often hangs loosely and does not stay effectively positioned over the marking. It is therefore desirable to provide a scar covering jewelry device that can be adhered to a bandage or to the wearer's skin in order to cover a scar or other marking thereon.

In light of the above devices disclosed in the known art, it is submitted that the present invention substantially diverges in design elements from the known art and consequently it is clear that there is a need in the art for an improvement to existing jewelry devices. In this regard the present invention substantially fulfills these needs.

SUMMARY OF THE INVENTION

In view of the foregoing disadvantages inherent in the known types of scar covering devices now present in the prior art, the present invention provides a scar covering jewelry device wherein the same can be utilized for providing convenience for the user when obscuring a scar or other marking from view. The present scar covering jewelry device includes a pendant having a front side, a rear side, a first end, and a second end. An ornament is disposed on the front side of the pendant. A chain includes a second end and an opposing first end, wherein the first end of the chain is secured to the first end of the pendant and the second end of the chain secured to the second end of the pendant. A removable adhesive is disposed on the rear side of the pendant. The removable adhesive is configured to adhere to a bandage or directly to the wearer's skin, such that the pendant may be utilized to obscure a scar, injury, or other are of the skin the wearer wishes to cover. The removable adhesive allows the device to be removed without leaving a residue behind.

Other objects, features, and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
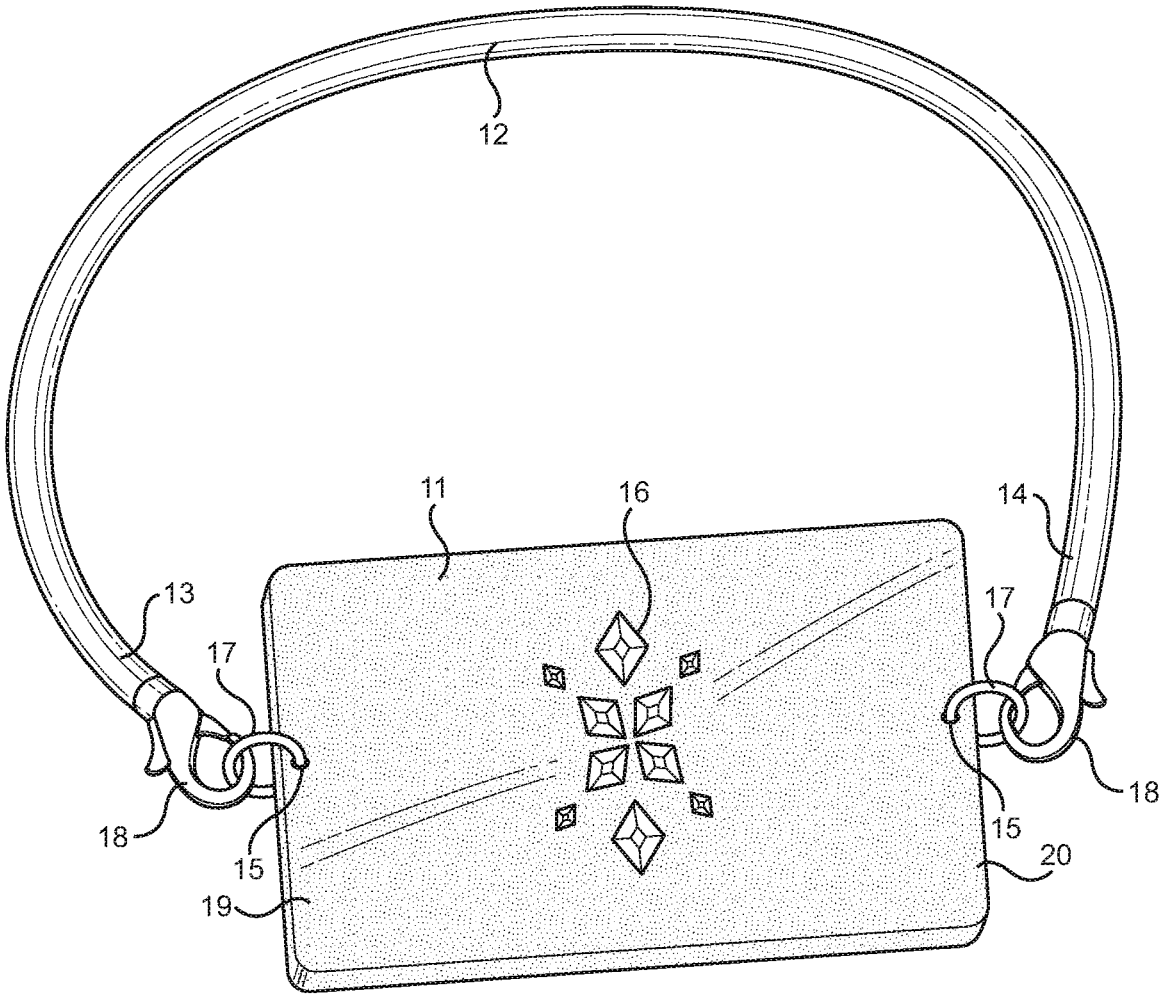
FIG. 1 shows a perspective view of the scar-covering jewelry device.

Reference is made herein to the attached drawings. Like reference numerals are used throughout the drawings to depict like or similar elements of the scar covering jewelry device. For the purposes of presenting a brief and clear description of the present invention, the preferred embodiment will be discussed as used for adhering to a bandage or to the wearer's skin for covering a scar or other marking. The figures are intended for representative purposes only and should not be considered to be limiting in any respect.

Referring now to FIG. 1, there is shown a perspective view of the scar covering jewelry device. The device includes a pendant 11 having an ornament 16 disposed centrally thereon. In the illustrated embodiment, the pendant 11 includes a rectangular perimeter, such that it can fully cover a rectangular bandage. However, the pendant 11 can include alternate perimeter shapes. Additionally, the design of the ornament 16 can vary according to the aesthetic preferences of the wearer. Some embodiments of the present invention may include interchangeable ornaments 16, such that the wearer may customize the appearance of the pendant 11.

A chain 12 is included for securing the pendant 11 around a body part of the wearer such as the wrist, arm, leg, neck, or the like. The chain 12 includes a first end 13 secured to a first end 19 of the pendant 11 and a second end 14 secured to a second end 20 of the pendant 11. It is to be understood that the chain 12 can be a rope, cord, or any suitable flexible connecting member. The chain 12 can be long enough such that the pendant 11 can be worn around the neck of the wearer, or may be shorter such that the pendant 11 can be worn around the wrist of the wearer. In one embodiment, the chain 12 is configured to be adjustable in length, allowing wearers to customize the fit of the device. The adjustability of the chain 12 allows the device to be worn in various configurations, such as around the neck as a choker or lower against the sternum, for example.

In the illustrated embodiment, the chain 12 includes a clasp 18 disposed on each of the first and second ends 13, 14 thereof. The clasp 18 can be a spring-loaded clasp or any suitable jewelry fastener. The clasps 18 allow the user to easily attach or remove the device around their wrist or neck. In the shown embodiment, one clasp 18 is removably secured to a ring 17 on the first side 19 of the pendant 11, and the other clasp 18 is removably secured to a ring 17 on the second side 20 of the pendant 11. Each ring 17 extends through a ring aperture 15 disposed on each end 19, 20 of the pendant 11. The inclusion of the rings 17 provides a flexible, adjustable connection between the chain 12 and the pendant 11, which allows the pendant 11 to be easily oriented to a desired position. In alternate embodiments, the first and second ends 13, 14 of the chain 12 can be inserted directly through the ring apertures 15, particularly in embodiments where the pendant 11 is flexible or embodiments that include cloth material designed for athletic or active use.

Figure 2:
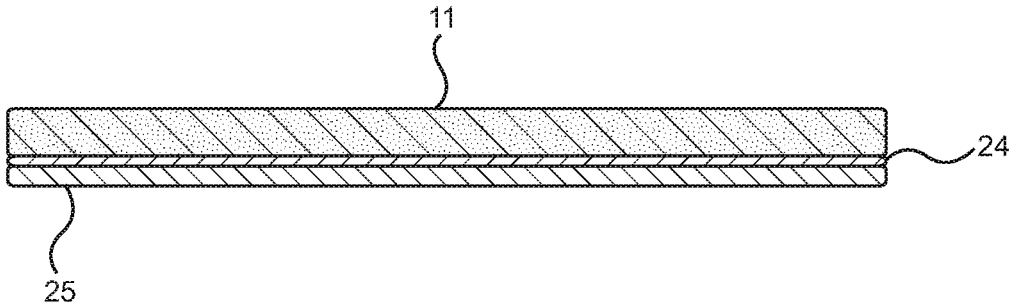
FIG. 2 shows a cross-sectional view of the pendant of the scar-covering jewelry device.

Referring now to FIG. 2, there is shown a cross-sectional view of the pendant of the scar-covering jewelry device. A removable adhesive 24 is disposed on the rear side of the pendant 11. The removable adhesive 24 is configured to removably adhere the pendant 11 to the wearer's skin, or to a bandage that has been previously affixed to the wearer. The removable adhesive 24 allows the device to be removed without leaving a residue behind on the wearer's skin or bandage. In the shown embodiment, a removable backing is disposed over the removable adhesive 24, preventing the removable adhesive 24 from accidentally adhering to a surface. The removable backing 25 can peeled off and discarded prior to wearing the pendant 11. Additionally, the removable adhesive 24 is reusable, such that the pendant 11 may be re-adhered to a surface after being removed from another surface.

Figure 3:
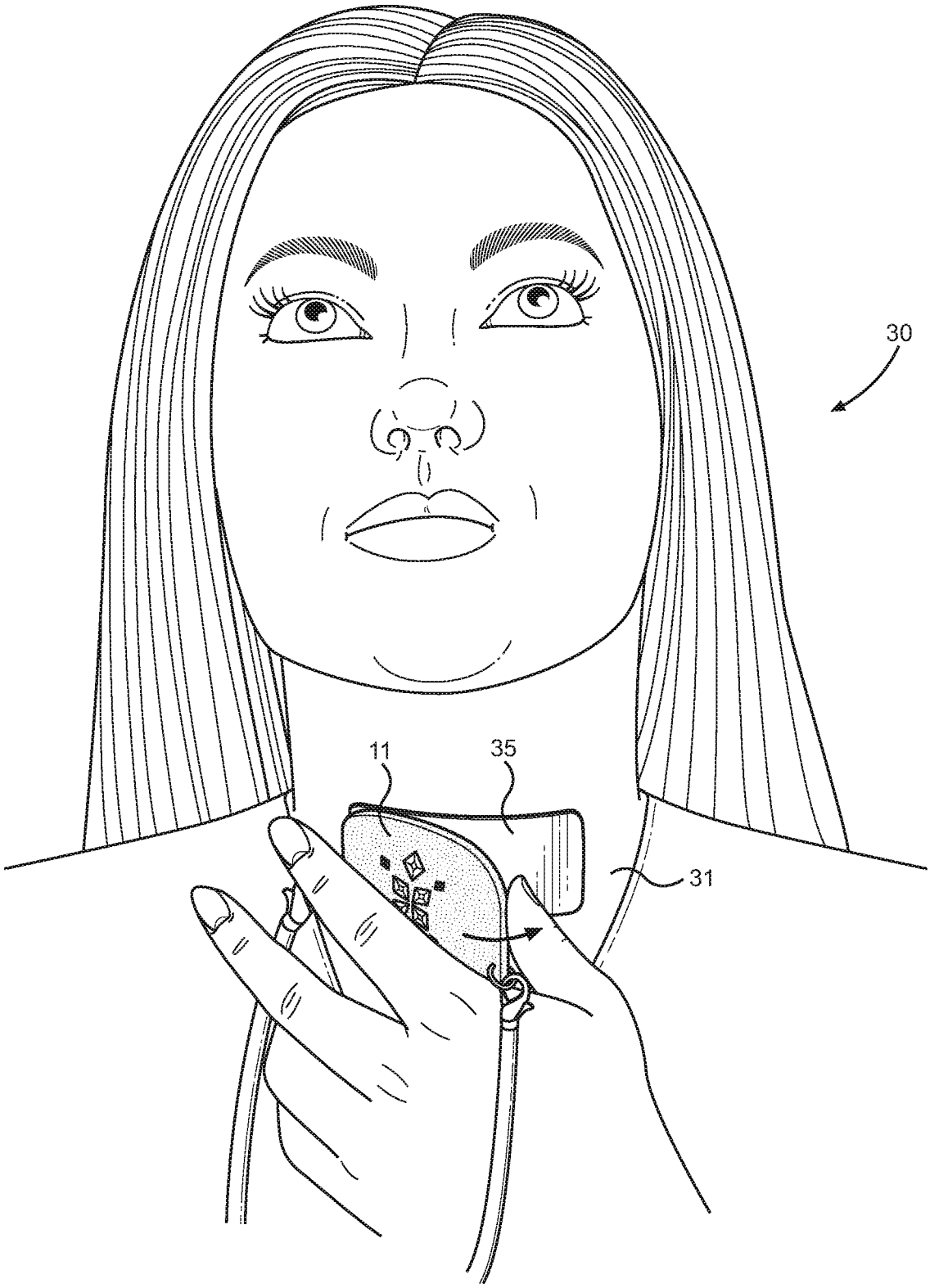
FIG. 3 shows a perspective view of a wearer securing the scar-covering jewelry device to themselves.
Figure 4:
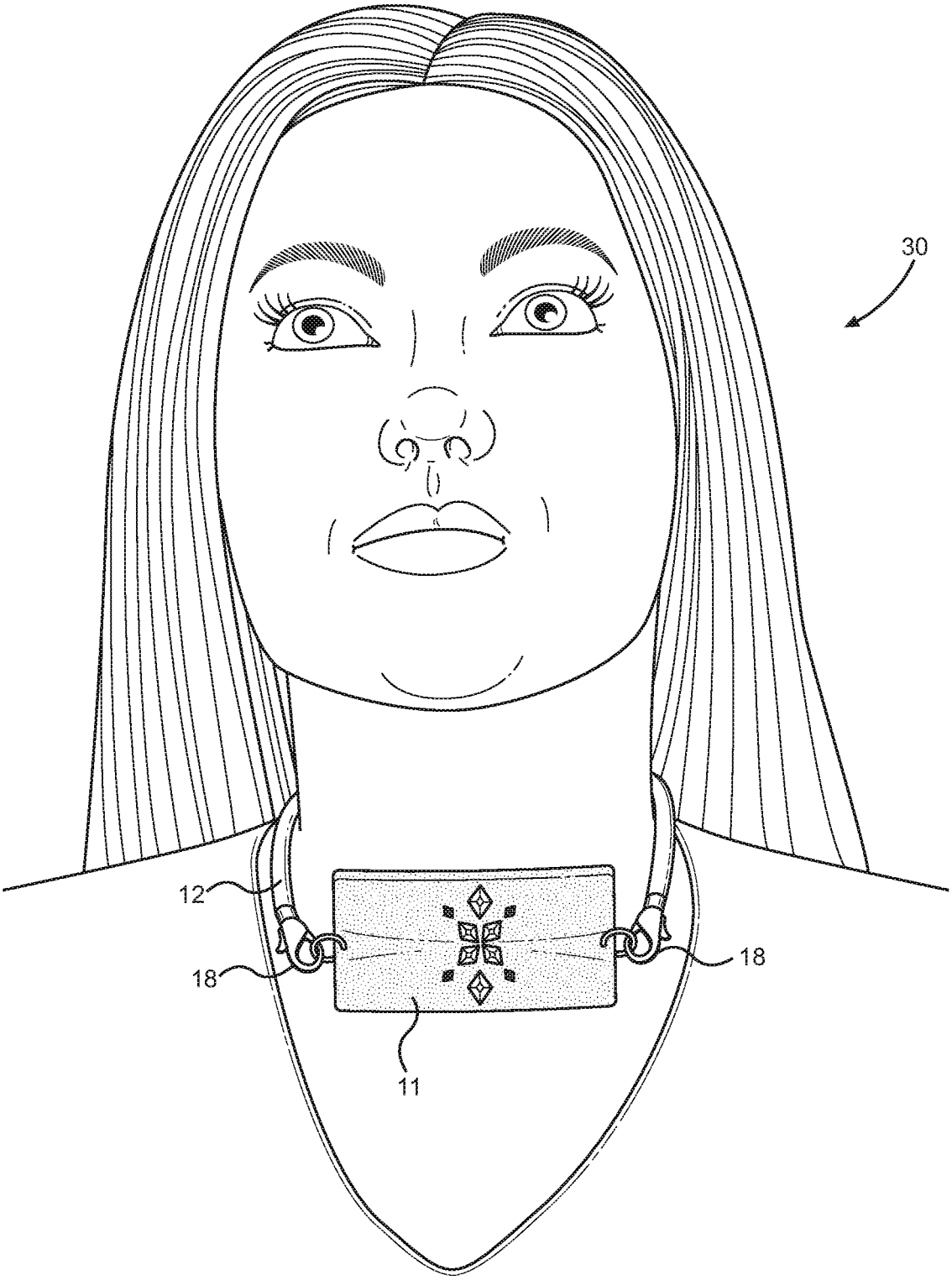
FIG. 4 shows a perspective view of the scar-covering jewelry device being worn by a wearer.

Referring now to FIGS. 3 and 4, there is shown a perspective view of a wearer securing the scar-covering jewelry device to themselves and a perspective view of the scar-covering jewelry device being worn by a wearer, respectively. In operation, a wearer 30 may remove the removable backing and adhere the pendant 11 to an area to be covered. In the shown embodiment, the wearer 30 attaches the pendant 11 to a bandage 3 placed on the wearer's throat 31. Alternatively, the pendant 11 can be attached directly to the wearer's 30 skin if there is no underlying bandage. The wearer 30 may attach the chain 12 to their neck, wrist, or other body part via the clasps 18. If desired, the wearer 30 may reverse the above steps, and attach the chain 12 around themselves prior to adhering the pendant 11 to themselves.

In the shown embodiment, the pendant 11 is flexible so that it may contour to the curvature of the wearer's body. In other embodiments, the pendant 11 can be rigid and non-flexible. Additionally, the removable adhesive may also be a reusable adhesive, such that the pendant 11 may be removed from the wearer 30 and reused if desired. Overall, the present invention provides a scar covering jewelry device that can be adhered to a bandage or directly to the wearer's skin in order to obscure an area of the wearer's body from view.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A scar-covering jewelry device, comprising:

a pendant having a front side, a rear side, a first end, and a second end;

wherein the pendant is flexible;

wherein the pendant can contour to a curvature of a wearer's body;

an ornament disposed on the front side of the pendant;

a chain having a first end and an opposing second end, wherein the first end of the chain is secured to the first end of the pendant and the second end of the chain secured to the second end of the pendant; and a removable adhesive disposed on the rear side of the pendant.

2. The scar-covering jewelry device of claim 1, further comprising a removable backing that is removably disposed over the removable adhesive on the rear side of the pendant.

3. The scar-covering jewelry device of claim 1, wherein the first end of the chain includes a first clasp thereon, and wherein the second end of the chain includes a second clasp thereon.

4. The scar-covering jewelry device of claim 3, wherein the first clasp is removably secured to a first aperture disposed on the first end of the pendant, and wherein the second clasp is removably secured to a second aperture disposed on the second end of the pendant.

5. The scar-covering jewelry device of claim 4, wherein the first clasp is removably secured to a first ring and the second clasp is removably secured to a second ring, wherein the first ring extends through the first aperture disposed on the first end of the pendant, and wherein the second ring extends through the second aperture disposed on the second end of the pendant.

6. The scar-covering jewelry device of claim 1, wherein the removable adhesive is also a reusable adhesive.

7. The scar-covering jewelry device of claim 1, wherein the pendant is rigid.

8. The scar-covering device of claim 1, wherein the pendant includes a rectangular perimeter.

9. The scar-covering device of claim 1, wherein the ornament is centrally disposed on the pendant.

10. The scar-covering device of claim 1, wherein the chain is adjustable in length.

11. A scar-covering jewelry device, comprising:

a pendant having a front side, a rear side, a first end, and a second end;

wherein the pendant is flexible;

wherein the pendant can contour to a curvature of a wearer's body;

an ornament disposed on the front side of the pendant;

a chain having a first end and an opposing second end, wherein the first end of the chain is secured to the first end of the pendant and the second end of the chain secured to the second end of the pendant;

a removable adhesive disposed on the rear side of the pendant; and wherein the removable adhesive does not leave a residue behind on a wearer's skin or bandage when the scar-covering jewelry device is removed.

12. A scar-covering jewelry device, consisting of:

a pendant having a front side, a rear side, a first end, and a second end;

wherein the pendant is flexible;

wherein the pendant can contour to a curvature of a wearer's body;

an ornament disposed on the front side of the pendant;

a chain having a first end and an opposing second end, wherein the first end of the chain is secured to the first end of the pendant and the second end of the chain secured to the second end of the pendant; and a removable adhesive disposed on the rear side of the pendant.

* * * * *